United States Patent [19]

DePetris

[11] Patent Number: 4,699,738

[45] Date of Patent: Oct. 13, 1987

[54] ELECTRICALLY HEATED CHOKE HAVING IMPROVED CONTROL

[76] Inventor: Peter DePetris, M.P.O. Box 906, Niagara Falls, N.Y. 14302

[21] Appl. No.: 823,594

[22] Filed: Jan. 29, 1986

[51] Int. Cl.[4] ..... F02M 1/12

[52] U.S. Cl. ..... 261/39.6; 219/505; 219/511; 236/101 C

[58] Field of Search ..... 261/39 E; 219/505, 511; 236/101 C

[56] References Cited

U.S. PATENT DOCUMENTS

| | | | |
|---|---|---|---|
| 3,699,936 | 10/1972 | Vartanian | 123/407 |
| 3,699,937 | 10/1972 | De Petris | 261/39 E |
| 3,972,311 | 8/1976 | De Petris | 261/39 E |
| 4.038,955 | 8/1977 | Paulmier | 261/39 E |
| 4,131,657 | 12/1978 | Ball, Jr. et al. | 261/39 E |
| 4,201,735 | 5/1980 | Byam | 261/39 E |
| 4,218,406 | 8/1980 | Detweilier | 261/39 E |
| 4,237,077 | 12/1980 | Berg | 261/39 E |
| 4,496,496 | 1/1985 | Walstra | 261/39 E |

FOREIGN PATENT DOCUMENTS

| | | | |
|---|---|---|---|
| 52-73237 | 6/1977 | Japan | 261/39 E |

*Primary Examiner*—Tim Miles

*Attorney, Agent, or Firm*—Harness, Dickey & Pierce

[57] ABSTRACT

An automatic choke mechanism including an electrical heater and a circuit for energizing the heater so that the choke is opened first at a relatively rapid rate and later at a slower rate. The means for heating the choke comprises an N.T.C. device in series circuit with a P.T.C. heater and a temperature responsive shunting circuit for shunting the N.T.C.

1 Claim, 4 Drawing Figures

ELECTRICALLY HEATED CHOKE HAVING IMPROVED CONTROL

BACKGROUND OF THE INVENTION

This invention relates to an electrically heated choke and more particularly to an improved electrically heated choke control circuit and control arrangement.

It is well known that the fuel/air requirements of an internal combustion engine vary in accordance with its temperature. This is particularly true at low temperatures when a richer than normal fuel/air mixture is required than when the engine is heated. In addition, additional fuel flow is required for cold starting. In view of these temperature sensitive fuel/air requirements, it has been the practice to provide internal combustion engines with some form of cold starting and cold running enrichment mechanism with an aim toward providing the proper fuel/air ratio under all running and starting conditions, particularly those where the engine is cold.

One commonly known type of cold starting and cold enrichment mechanism utilizes a choke valve in the induction passage and specifically in the carburetor for restricting the air flow in relation to temperature. When the air flow is restricted, a richer fuel/air mixture will result and the fuel/air mixture can be varied throughout the engine temperature ranges by appropriately controlling the choke valve.

Although the temperature responsive fuel/air requirements of internal combustion engines is well known as is the use for choke valve controlled enrichment, the effectiveness of automatic chokes of the type heretofore proposed has not provided the proper fuel/air ratio for all running conditions and has resulted in poor running or, alternatively, poor fuel economy and high exhaust gas emissions.

More recently it has been proposed to employ electrical heating devices for heating the thermally responsive element that controls the choke valve so as to provide a better control over the fuel/air mixture. Such devices are shown in my U.S. Pat. Nos. 3,699,937 and 3,972,311. Although these devices, which employ positive temperature coefficient heaters for heating the temperature responsive element offer significant advantages over the prior art type of choke mechanisms embodying either exhaust gases or engine coolant as the heating element, they still do not provide the desired degree of choke control under all running conditions. It has been discovered that the most effective choke control and best running can be accomplished if the choke is held closed or substantially closed at a low temperature and then is opened rapidly up to a predetermined position and at a predetermined temperature. When this temperature condition is reached, the continued opening of the choke valve should be maintained at a relatively constant rate until a further predetermined higher temperature is reached. At this temperature, it is desirable to further increase the rate of opening of the choke valve until the engine reaches its operating temperature or a temperature that is relatively close to the normal operating temperature. The types of choke control and heating mechanisms previously proposed simply have not been able to achieve this type of temperature choke position relationship.

It is, therefore, a principal object of this invention to provide an improved choke mechanism for an internal combustion engine.

It is a yet further object of this invention to provide an improved electrically heated choke.

It is a still further object of this invention to provide an improved control mechanism for controlling the current supplied to an electrically heated choke.

SUMMARY OF THE INVENTION

This invention is adapted to be embodied in an automatic choke mechanism for an internal combustion engine comprising a choke valve, means including a thermally responsive member for positioning the choke valve for urging the choke valve toward a closed position when the thermally responsive member is at a temperature below a predetermined temperature and for opening the choke valve in response to the elevation of the temperature of the thermally responsive member and electrical heating means in proximity to the thermally responsive member for heating the thermally responsive member. In accordance with the invention, means are provided for supplying electrical power to the electrical heating means at a first, relatively high rate when the thermally responsive member is at a temperature below the predetermined temperature, at a second lower rate when the thermally responsive member is at a temperature above the predetermined temperature and below an elevated temperature and at a relatively high rate when the thermally responsive member is above the predetermined higher temperature.

DETAILED DESCRIPTION OF THE PREFERRED EMBODIMENT

Figure 1:
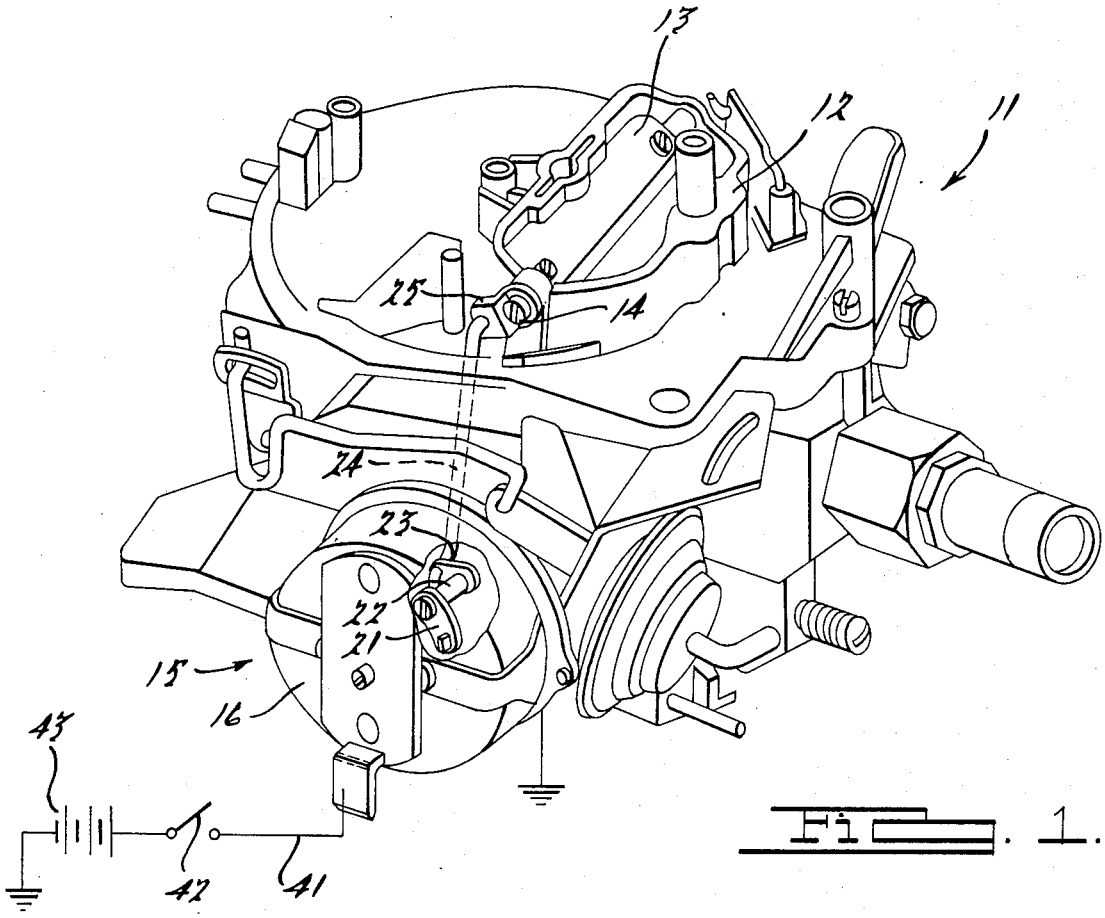
FIG. 1 is a perspective view of a charge forming device such as a carburetor embodying a choke valve constructed in accordance with an embodiment of the invention.

In the drawings the reference numeral 11 indicates generally a carburetor having a choke control mechanism constructed in accordance with this invention. The carburetor 11 has an airhorn 12 in which a choke valve 13 is rotatably supported on a choke valve shaft 14. As is well known, the choke valve 13 is operated so as to provide cold starting and cold running enrichment.

A choke valve control mechanism, indicated generally by the reference numeral 15, is provided for rotatably positioning the choke valve 13 in response to engine temperature. In accordance with this invention, the choke valve control mechanism 15 is electrically operated and provides an electrical heating element, as will be described. It is to be understood, however, that the electrical heating may be supplemented by exhaust gas heating in a known manner.

The choke valve control mechanism 15 includes a cover plate, indicated generally by the reference numeral 16, which may be formed from any suitable nonmetallic material; for example, a molded plastic as is well known in this art. The cover 16 defines an internal cavity 17 in which a coiled bimetallic spring 18 is positioned. One end of the spring 18 is connected to a lever 21 that is affixed to a shaft 22 that is journaled in a known manner in the body of the carburetor 11. The opposite end of the shaft 22 carries a second lever 23 that is connected by means of a link 24 to a lever 25 that is affixed to the choke valve shaft 14 for rotating the choke valve shaft 14 and choke valve 13 in response to the temperature of the bimetallic spring 18.

A copper heat sink 26 is affixed to the cover 16 within the cavity 17 on a post portion 27 formed integrally with the cover 16 and extending within the cavity 17. The post portion 27 is formed with a cylindrical opening 28 and a positive temperature coefficient electrical heater 29 (P.T.C.) in the form of a thermistor is received within the opening 28 and is in electrical contact with the heat sink 26. Heat sink 26 is affixed to the cover plate 16 by means of a pair of rivets 31 that are, in turn, connected to electrical ground straps 32 that engage the support ring of the choke housing 16 and are connected appropriately to the ground as shown in FIG. 1 and the electrical schematic of FIG. 4.

Figure 2:
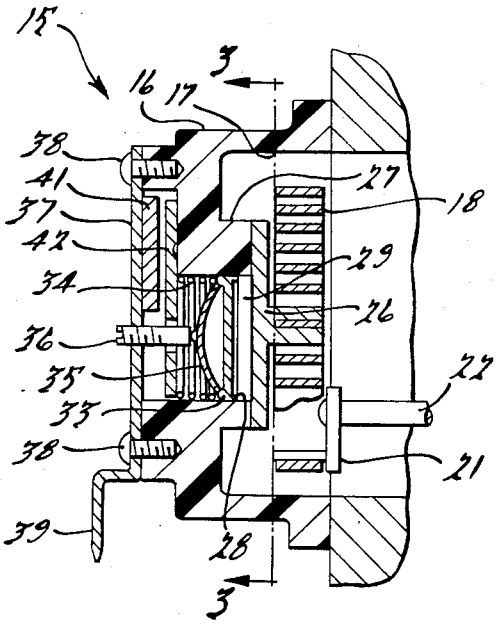
FIG. 2 is a cross-sectional view taken through the choke valve positioning mechanism.
Figure 3:
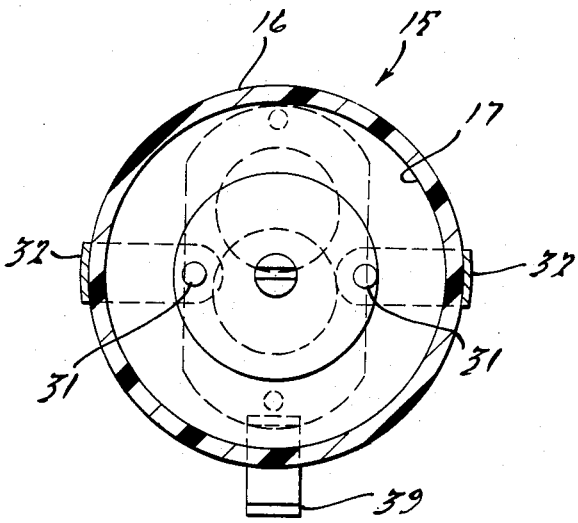
FIG. 3 is a cross-sectional view taken generally along the line 3—3 of FIG. 2.

A further heat sink 33 is contained within the opening 28 and is in electrical contact with the P.T.C. 29. A coil compression spring 34 contacts the periphery of a bimetallic Belleville disk 35 that is contained within the cavity 28 and which has its peripheral edge held in engagement with the heat sink 33. A bimetallic disk 35 is such that when its temperature is low it assumes a convex shape as shown in FIG. 2. In this condition, the center of the disk 35 contacts an adjustable terminal 36 that is screwed into a contact plate 37 that is affixed to the cover plate 16 by means of screws 38. The contact plate 37 has a terminal portion 39 that is adapted to provide a contact through a circuit including a conductor 40 and the ignition switch 50 with a battery 43.

When the bimetallic disk 35 is at a temperature greater than a predetermined temperature, it will snap from the convex shape as shown in FIG. 2 to a concave shape wherein its center no longer engages the adjustable contact 36.

Figure 4:
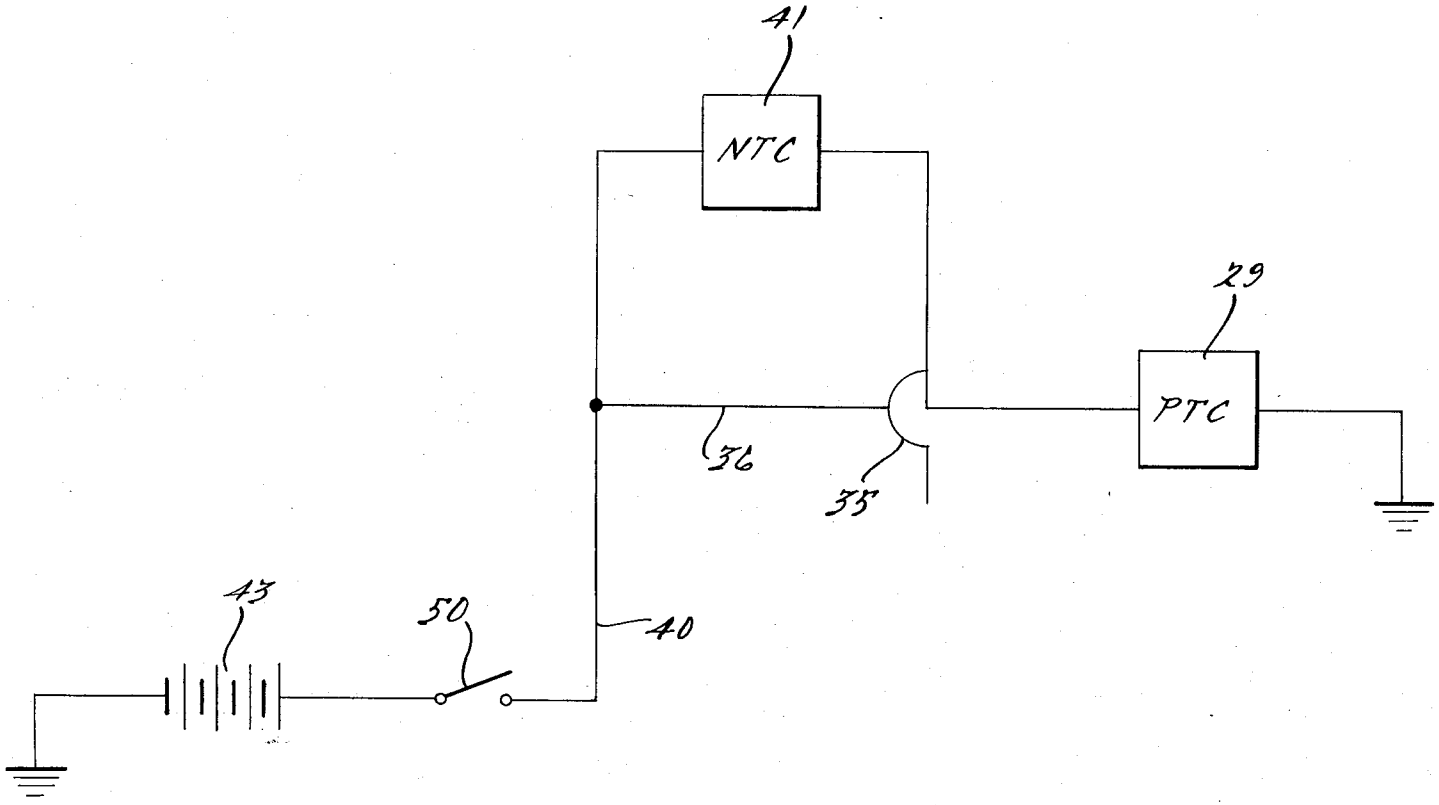
FIG. 4 is a schematic electrical circuit showing the choke heating mechanism.

A negative temperature coefficient thermistor (N.T.C.) 41 is affixed to the strap 37 and is in electrical contact with it. The other side of the N.T.C. 41 is in engagement with a conductor 42 which, in turn, acts as a reaction member against which the spring 34 bears. Hence, the N.T.C. 41 is always in series circuit between the battery 43 and the P.T.C. device 29 as is clearly shown in FIG. 4. However, when the snap disk 35 is in its low temperature condition as shown in FIGS. 2 and 4, the N.T.C. will be shunted out of the circuit by a direct connection between the battery 43 and the P.T.C. 29 through the contact 36 and snap disk 35.

The device operates as follows. When the engine associated with the carburetor 11 is cold and the bimetal spring 18 has cooled, if the temperature is below the predetermined temperature, the bimetal washer 35 will have snapped to the position shown in FIGS. 2 and 4 and complete the shunting circuit around the N.T.C. 41. Thus, if the ignition switch 50 is closed to start the engine, the battery 43 will be placed in circuit with the P.T.C. 29 through the adjustable terminal 36, snap washer 35 and heat sink 33. Thus, during initial starting and running of the engine, full power will be supplied to the P.T.C. 29 and rapid heating will occur.

As the heating continues, the P.T.C. 29 will heat the heat sink 33 and bimetallic washer 35 as well as the temperature responsive spring 18. Thus, as the spring 18 unwinds and gradually opens the choke valve 13, the bimetallic washer 35 will be simultaneously heated.

Eventually the bimetallic washer 35 will be heated sufficiently that it will snap to its concave position and open the shunting circuit to the P.T.C. 29. Up until this time, the rate of heating of the P.T.C. 29 will be dependent upon its internal characteristics and this will occur at a relatively rapid rate.

When the shunting circuit is opened by the snapping of the bimetallic washer 35, the only source of current to the P.T.C. 29 will be through the N.T.C. 41. As the temperature is low, the resistance current flow will be relatively great and a small current will be transmitted to the P.T.C. so that its rate of heating will then be decreased markedly from the previous rate when the N.T.C. was shunted. As the temperature continues to increase due to the more gradual heating of the P.T.C., the N.T.C. will also become heated and its resistance will decrease so that the rate of heating is now determined by the characteristics of the N.T.C. 41 and P.T.C. 29. However, as the N.T.C. heats there will be a lesser and lesser resistance and a greater and greater flow of heating to the P.T.C. so that the bimetallic spring 18 will be heated rapidly and the choke valve 13 will open.

It should be readily apparent, therefore, that the rate of heating of the bimetallic spring 18 is relatively rapid initially then at a slower rate and then gradually increasing to a rapid rate so that the opening of the choke valve 13 will more closely follow the demands of the engine associated with the carburetor 11.

It should be noted that at extremely low temperatures, the bimetallic washer 35 may snap several times wherein first it is heated and opens the shunting circuit and then it cools due to the slower heating of the P.T.C. 29 so as to cause the spring 35 to snap back and establish the shunting circuit. This may occur several times at low temperatures. However, during warmer operation the disk may snap only once depending upon the temperature.

It should be also apparent to those skilled in the art that the device permits tailoring of the choke opening to the desired characteristics by preferably selecting the heat sinks and coefficients of the P.T.C. and N.T.C. In addition, the contact 36 may be adjusted so as to further provide control over the system.

Although an embodiment of the invention has been illustrated and described, various changes and modifications may be made, without departing from the spirit and scope of the invention, as defined by the appended claims.

I claim:

1. A device for heating the bimetallic coil spring of an automatic choke comprising an insulating housing having a generally cup-shape, a heat sink carried by said housing and adapted to be affixed at one end thereof to the bimetallic spring, a positive temperature coefficient thermistor in engagement with said heat sink and in circuit therewith, a second heat sink in contact with another side of the positive temperature coefficient thermistor, a negative temperature coefficient thermistor carried by the cover and means for delivering electrical power to the negative temperature coefficient thermistor, said last name means being in circuit with an adjustable contact positioned in proximity to the second heat sink, and a bimetallic snap disk engaged at its outer periphery with said second heat sink and adapted to contact said adjustable contact for shunting said negative temperature coefficient thermistor.

* * * * *